US009476152B2

(12) United States Patent
Card, Sr.

(10) Patent No.: US 9,476,152 B2
(45) Date of Patent: Oct. 25, 2016

(54) TUFTING SYSTEM WITH MINI-STAGGERED NEEDLES

(71) Applicant: Card-Monroe Corp., Chattanooga, TN (US)

(72) Inventor: Lewis Card, Sr., Chattanooga, TN (US)

(73) Assignee: Card-Monroe Corp., Chattanooga, TN (US)

( * ) Notice: Subject to any disclaimer, the term of this patent is extended or adjusted under 35 U.S.C. 154(b) by 530 days.

(21) Appl. No.: 14/173,053

(22) Filed: Feb. 5, 2014

(65) Prior Publication Data

US 2015/0211161 A1 Jul. 30, 2015

Related U.S. Application Data

(60) Provisional application No. 61/932,329, filed on Jan. 28, 2014.

(51) Int. Cl.
*D05C 15/12* (2006.01)
*D05C 15/20* (2006.01)

(52) U.S. Cl.
CPC ..... *D05C 15/12* (2013.01); *D05C 15/20* (2013.01)

(58) Field of Classification Search
CPC ..... D05C 15/12; D05C 15/20
USPC ..... 112/80.4, 80.45, 80.23, 80.43
See application file for complete search history.

(56) References Cited

U.S. PATENT DOCUMENTS 3,443,534 A 5/1969 Lund
4,067,270 A 1/1978 Short
4,158,339 A 6/1979 Short
4,503,787 A 3/1985 Watkins
4,519,326 A 5/1985 Green et al.
4,800,828 A 1/1989 Watkins
4,981,091 A 1/1991 Taylor et al.
5,005,498 A 4/1991 Taylor et al.
5,058,518 A 10/1991 Card et al.
5,193,472 A 3/1993 Crossley
5,224,434 A 7/1993 Card et al.
5,383,415 A 1/1995 Padgett, III
5,526,760 A 6/1996 Ok
5,544,605 A 8/1996 Frost
5,549,064 A 8/1996 Padgett, III
5,575,228 A 11/1996 Padgett, III et al.
5,588,383 A 12/1996 Davis et al.
5,622,126 A 4/1997 Card et al.
5,706,744 A 1/1998 Card et al.
5,738,030 A 4/1998 Ok
5,743,201 A 4/1998 Card et al.

(Continued)

FOREIGN PATENT DOCUMENTS

GB 2 255 785 11/1992

*Primary Examiner* — Danny Worrell
(74) *Attorney, Agent, or Firm* — Womble Carlyle Sandridge & Rice, LLP; David Sudderth

(57) ABSTRACT

A tufting machine for forming tufted articles such as carpets including one or more needle bars carrying a series of spaced needles. The needles are arranged in 2 or more transverse rows of needles, with the needles of each transverse row of needles being mounted in a mini-staggered arrangement along the one or more needle bars. A series of gauge parts are mounted below backing material passing through the tufting machine. The gauge parts each engage corresponding ones of the needles of each transverse row of needles following penetration of the backing material by the needles, so as to form multiple tufts of yarns in the backing material.

18 Claims, 6 Drawing Sheets

(56) References Cited

U.S. PATENT DOCUMENTS

| | | | | |
|---|---|---|---|---|
| 5,794,551 | A | 8/1998 | Morrison et al. | |
| 5,806,446 | A | 9/1998 | Morrison et al. | |
| 5,979,344 | A | 11/1999 | Christman, Jr. | |
| 5,983,815 | A | 11/1999 | Card | |
| 6,009,818 | A | 1/2000 | Card et al. | |
| 6,014,937 | A | 1/2000 | Lovelady | |
| 6,213,036 | B1 | 4/2001 | Slattery | |
| 6,244,203 | B1 | 6/2001 | Morgante et al. | |
| 6,283,053 | B1 | 9/2001 | Morgante et al. | |
| 6,439,141 | B2 | 8/2002 | Morgante et al. | |
| 6,516,734 | B1 | 2/2003 | Morgante et al. | |
| 6,550,407 | B1 | 4/2003 | Frost et al. | |
| 6,807,917 | B1 | 10/2004 | Christman et al. | |
| 6,834,601 | B2 | 12/2004 | Card et al. | |
| 6,877,449 | B2 | 4/2005 | Morgante et al. | |
| 6,886,477 | B2 | 5/2005 | Vaughan et al. | |
| 7,162,964 | B2 | 1/2007 | Vaughan et al. | |
| 7,216,598 | B1 * | 5/2007 | Christman, Jr. ..... | D05C 15/14 112/475.23 |
| 7,481,172 | B2 | 1/2009 | Vaughan | |
| 7,717,051 | B1 | 5/2010 | Hall et al. | |
| 7,739,970 | B2 | 6/2010 | Hall | |
| 7,905,187 | B2 | 3/2011 | Card et al. | |
| 7,946,233 | B2 * | 5/2011 | Hall ..... | D05C 15/12 112/80.4 |
| 8,141,506 | B2 | 3/2012 | Hall et al. | |
| 8,359,989 | B2 | 1/2013 | Hall et al. | |
| 8,443,743 | B2 | 5/2013 | Christman, Jr. | |
| 9,222,207 | B2 * | 12/2015 | Weiner ..... | D05C 15/30 |
| 9,290,874 | B2 * | 3/2016 | Mathews ..... | D05C 15/14 |
| 2002/0037388 | A1 | 3/2002 | Morgante et al. | |

* cited by examiner

TUFTING SYSTEM WITH MINI-STAGGERED NEEDLES

CROSS REFERENCE TO RELATED APPLICATIONS

The present patent application is a formalization of previously filed, co-pending U.S. Provisional Patent Application Ser. No. 61/932,329, filed Jan. 28, 2014 by the inventor named in the present application. This patent application claims the benefit of the filing date of this cited Provisional Patent Application according to the statutes and rules governing provisional patent applications, particularly 35 U.S.C. §119(a)(i) and 37 C.F.R. §1.78(a)(4) and (a)(5). The specification and drawings of the Provisional Patent Application referenced above are specifically incorporated herein by reference as if set forth in their entirety.

FIELD OF THE INVENTION

The present disclosure generally is directed to systems and methods of forming tufted articles such as carpets. In particular, the present disclosure is directed to a system and method for forming tufted articles including a series of needles mounted in a mini-staggered needle arrangement.

BACKGROUND OF THE INVENTION

In the tufting of carpets, rugs and other, similar products, as in most industries, it is desirable to increase production rates for the production of such tufted articles as much as possible. Increasing production rates increases efficiency and can save and/or lead to reduced costs of manufacturing, such as by reducing labor costs, by reducing the time required to produce a greater volume of tufted articles. In addition, as consumer tastes and preferences change, the demand for new and more complex or dynamic patterned carpets has increased. However, the formation of carpets including various pattern effects, for example shifting needle bars, forming of high/low pattern effects and the like, can limit production rates.

Accordingly, it can be seen that a need exists for a system and method for forming tufted articles such as carpets that enables increased production rates for the formation of such tufted articles, including the formation of patterned tufted articles, and which addresses the foregoing and other related and unrelated problems in the art.

SUMMARY OF THE INVENTION

Briefly described, in one embodiment, the present invention is directed to a system and method for forming tufted articles such as carpets, which is designed to facilitate the formation of such tufted articles at increased production rates. In one aspect, the tufting system can include a tufting machine having a machine frame defining a tufting area through which a backing material is passed for the insertion of yarns to form tufts of yarns in the backing material. One or more yarn feed mechanisms, for example, first and second or front and rear yarn feed mechanisms can be arranged along the front and/or rear or upstream and/or downstream sides of the tufting machine for feeding a series of yarns to corresponding needles. The one or more yarn feed mechanisms can include various yarn feed systems or pattern attachments, including single-end, double-end, scroll, roll and standard yarn feed devices or attachments, which can be controlled by a tufting machine controller to control feeding of the yarns to their respective needles as desired. The one or more yarn feed mechanisms also typically will have one or more creels or yarn supplies associated therewith for feeding a supply of yarns to one or more of the yarn feed mechanisms.

The tufting machine further will include at least one needle bar carrying the needles, the needles are mounted in two or more transversely extending rows of needles, and with the needles of each row arranged at an increased or enhanced gauge spacing that generally is less than a prescribed or desired fabric or pattern gauge spacing for the tufted article. For example, the needles of each row can be arranged at an increased gauge density spacing whereby the transverse spacing between the needles can be approximately half of a desired gauge of the tufting machine or tufted pattern being formed, or at other varying transverse spacings. Thus, the needles can be arranged in a mini staggered arrangement or reduced transverse spacing with an increased number of needles being provided, i.e., a greater number of needles per inch than generally provided for forming a tufted fabric of a desired or prescribed gauge per inch. For example, the needles further can be arranged at an approximately double gauge density transverse spacing or mini stagger, i.e. for $1/10^{th}$ gauge fabric/machine set-up, the needles can be arranged at a transverse or mini-stagger of approximately $1/20^{th}$ of an inch, such that there are approximately two times the number of needles per inch in each of the rows of needles. Greater or lesser transverse needle spacings and/or numbers of needles also can be used.

The rows of needles further can be mounted along a single needle bar or along multiple needle bars. In another embodiment, the needles can be mounted in modules, with a series of modules being stacked in a longitudinal arrangement across the tufting zone and mounted to a common needle bar or multiple needle bars as needed. The rows of needles further will be longitudinally spaced or staggered, preferably at a minimum stagger distance based upon the geometry/size or gauge of the needles being used. The needles of the transverse needle rows further generally will be longitudinally staggered or arranged front to back in a substantially parallel alignment. In one embodiment, the needles of each row further can be located in an effectively in-line arrangement, whereby corresponding or associated needles of each of the rows of needles generally will be arranged substantially parallel with respect to the tufting zone, and with the needles of successive rows being slightly moved or shifted toward a pickup side along which the needles are engaged by corresponding gauge parts as the needles penetrate backing material, as needed to facilitate engagement of the needles of both rows by their associated gauge parts.

The gauge parts that engage the needles can include a series of cut pile hooks, loop pile loopers, level cut loop loopers, cut/loop clips and/or other gauge parts as will be understood in the art. The gauge parts can be arranged at a spacing approximately corresponding to the mini-stagger or transverse spacing of the needles of each row of needles. The gauge parts will be reciprocated across the tufting zone as the rows needles penetrate the backing material, with the amount or distance of the reciprocating movement or path of travel of the gauge parts across the tufting zone being sufficient to enable at least a portion of the gauge parts to pass by and engage the longitudinally aligned needles of each of the rows of needles associated or aligned therewith. As a result, the gauge parts will pick up multiple loops of yarns, generally at least one loop of yarn from each of the needles engaged thereby, to form multiple tufts in the backing material during each pattern step or cycle of the needles.

In addition, the backing material can be fed through the tufting zone at an increased stitch rate. In one embodiment, the backing material can be run at a stitch rate that is a multiple of the machine or pattern stitch rate that is based upon a desired gauge of the tufts of yarns being formed, and/or based upon the number of needles per inch provided. For example, for a $1/10^{th}$ gauge tufted pattern in which a desired, programmed pattern or machine stitch rate of 10 stitches per inch is to be run, the needles of each row can be mounted at a double density gauge spacing, i.e., at $1/20^{th}$ spacings, and the backing material can run at approximately 2 times the machine stitch rate, i.e., about 20 stitches per inch, to form the tufted fabric with tufts being formed at approximately 10 stitches per inch at an increased production rate. Other, lesser or greater stitch rates also can be run. The amount of yarns being fed to the needles also can be increased as the tufts of yarn are being formed in the backing material, with the resultant tufted fabric having a desired fabric or pattern stitch density or number of stitches per inch, while being formed at an increased production rate.

Various features, objects and advantages of the present invention will become apparent to those skilled in the art upon a review the following detailed description, when taken in conjunction with the accompanying drawings.

Figure 1:
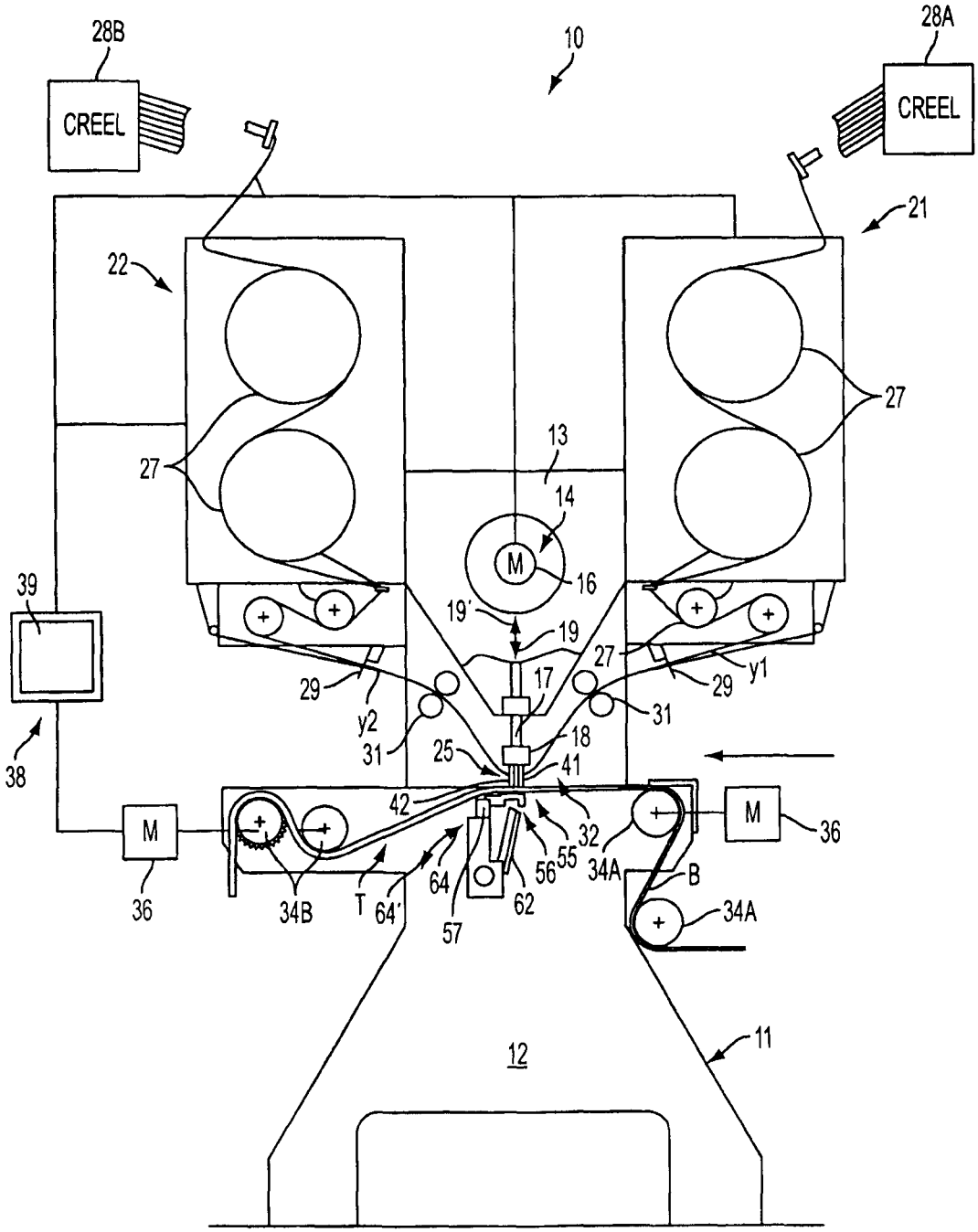
FIG. 1 is a side elevational view schematically illustrating one example embodiment of a tufting machine incorporating the features of the present invention.

The embodiments of the invention and the various features thereof are explained below in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments and/or features of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

DETAILED DESCRIPTION

Referring now to the drawings in which like numerals indicate like parts throughout the several views, FIG. 1 generally illustrates a tufting machine or system 10 that can be configured in accordance with the principles of the present invention in order to form tufted articles such as carpets, including loop pile, cut pile and various patterned carpets, rugs and other similar articles or products, at enhanced or increased production rates. The tufting machine 10 can include a frame 11 having a base 12 and a head or upper portion 13. A main drive shaft 14 can be mounted within the head portion 13 of the tufting machine 10 and can be driven by one or more motors 16. The main drive shaft will be linked or connected to a series of push rods 17, which support one or more needle bars 18 (or 18/18' in FIG. 2C), with the one or more needle bars 18 generally being moved in a vertically reciprocating manner or fashion, as indicated by arrows 19 and 19' in FIG. 1, as the main drive shaft is rotated to drive the reciprocating operation of the push rods.

As further indicated in FIG. 1, one or more yarn feed mechanisms 21 and 22 can be mounted on the frame 11 of the tufting machine and will feed a series of yarns, indicated by Y1 and Y2 to the needles 25 mounted along the length of the one or more needle bars 18. The one or more yarn feed mechanisms can include standard or conventional yarn feed mechanisms, as indicated in FIG. 1, having a series of yarn feed rolls 27 which receive the yarns Y1 and Y2 from one or more creels 28A/28B or other, similar yarn supply devices. Alternatively, the one or more yarn feed mechanisms or devices 21 and 22 can include various yarn feed pattern attachments such as scroll, roll, single or double end yarn feed attachments, such as an Infinity™, Infinity IIE™, or Yarntronics™ pattern attachments/yarn feed systems as manufactured by Card-Monroe Corp. which can control the feeding of the yarns to each of the needles 25, including varying the yarn feed in accordance with pattern instructions as needed or desired.

In one embodiment, as illustrated in FIG. 1, at least two yarn feed mechanisms 21 and 22 can be mounted on the same or on opposite sides of the tufting machine, i.e., on an upstream side and on a downstream side thereof, defining a first or upstream yarn feed mechanism 21 and a second or downstream yarn feed mechanism 22. Other arrangements, including a single yarn feed mechanism mounted along the upstream or the downstream side of the tufting machine and which can have a capacity to feed expanded or increased numbers of yarns also can be used. The creels 28A/28B will supply a series of yarns to the yarn feed mechanisms, which creels can be sized/adapted to feed increased numbers of yarns to the yarn feed mechanisms. The yarns will be fed from the yarn feed mechanisms 21 and 22 through guides 29 and puller rolls 31 to each of the needles 25 for insertion into the backing material B moving through a tufting zone 32 defined within the tufting machine 10.

The backing material B generally will be fed through the tufting zone 32 along a longitudinal path of travel, as indicated by arrow 33, by operation of a series upstream and downstream backing feed rolls 34A and 34B. As the backing material moves through the tufting zone, the needles 25 will be reciprocated into and out of the backing material, carrying the yarns Y1 and Y2 therewith for forming a series of tufts T in the backing material, as generally indicated in FIG. 1. The backing feed rolls 34A and 34B are driven under control of one or more motors 36, which can be operated at varying speed in order to control the effective or actual stitch rate at which the backing material B is fed through the tufting zone.

As additionally indicated in FIG. 1, the tufting machine or system 10 generally can be controlled by a tufting machine control system, indicated at 38. The control system can include a Command Performance™ control system as manufactured by Card-Monroe Corp., and can include an operator interface 39, such as a touch screen, monitor with a keyboard and/or mouse, or other, similar interface through which the operator can input and/or adjust various operating parameters at the tufting machine so as to control the feeding of the yarns to the needles 25 by the yarn feed mechanisms, stitch rate (backing feed), and other operations. For example, the one or more needle bars 18 can be connected to a needle bar shifter, such as a Smart Step™ shift mechanism, as manufactured by Card-Monroe Corp., a cam shifter, or other, similar shift mechanism. In addition, the control system can be linked to the server or plank control system either directly or through Wi-Fi or other remote connection for remote operation of the tufting system.

As generally indicated in FIGS. 1-5, the needles 25 can be mounted in two or more rows of needles, such as, for example, indicated at 41-43 in FIGS. 2A-2D. The needles of each row of needles will be mounted in transversely spaced series extending along the length of the one or more needle bars 18. The needles 25 of each row of needles generally can be mounted in a mini-staggered or increased gauge density arrangement, with the transverse spacing between the needles being substantially less than a prescribed or desired fabric gauge spacing of the tufts of the tufted fabric based on the desired fabric gauge of the tufted article or machine set-up. In one embodiment, the needles can be arranged at a double gauge density, such that, for example, for tufting a $1/10^{th}$ fabric gauge article, the needles can be arranged at a spacing of approximately $1/20^{th}$ of an inch; at $1/16^{th}$ of an inch for a $1/8^{th}$ fabric gauge; at about $5/64^{th}$ of an inch for $5/32^{nd}$ fabric gauge, etc. Other increased gauge density spacings also can be used, including increased gauge density spacings less than or greater than a double gauge density spacing. As a result of such an increased gauge density spacing, an increased number of needles per inch also can be provided, generally based upon a multiple of the desired fabric gauge. Thus, for example, for a desired $1/10^{th}$ gauge fabric, with a needle spacing of approximately $1/20^{th}$ is used, approximately 20 needles per inch can be mounted along the one or more needle bars. Other, varying numbers of needles also can be used, based upon the increased density spacing selected for the needles.

Figure 2A:
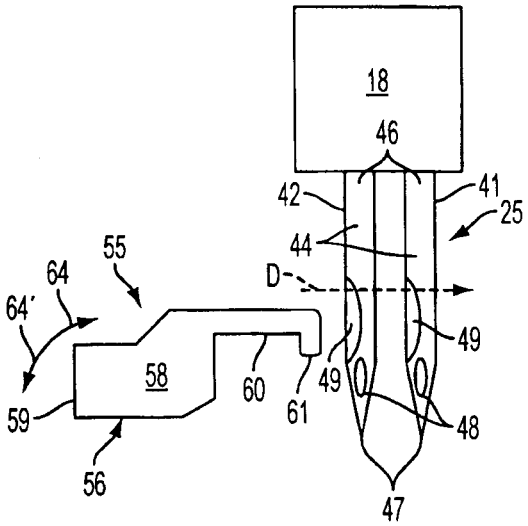
FIG. 2A-2D are side elevational views illustrating example arrangements of the rows of needles to be engaged by an associated or aligned gauge part mounted along one or more needle bars, in accordance with the principles of the present invention.
Figure 2B:
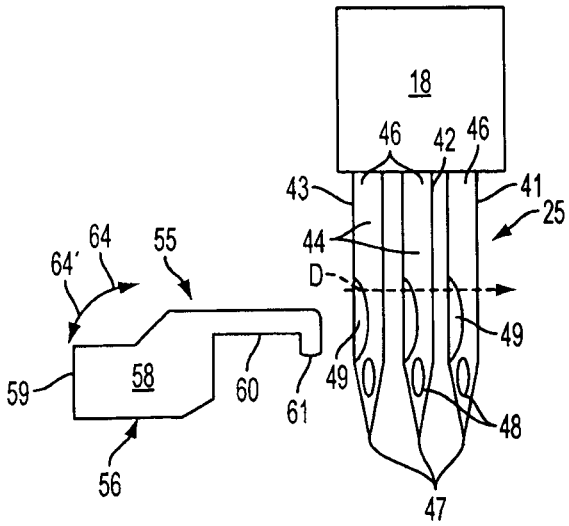
Figure 2C:
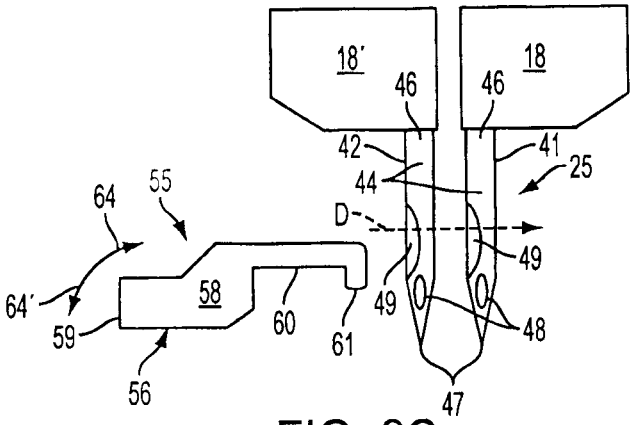
Figure 2D:
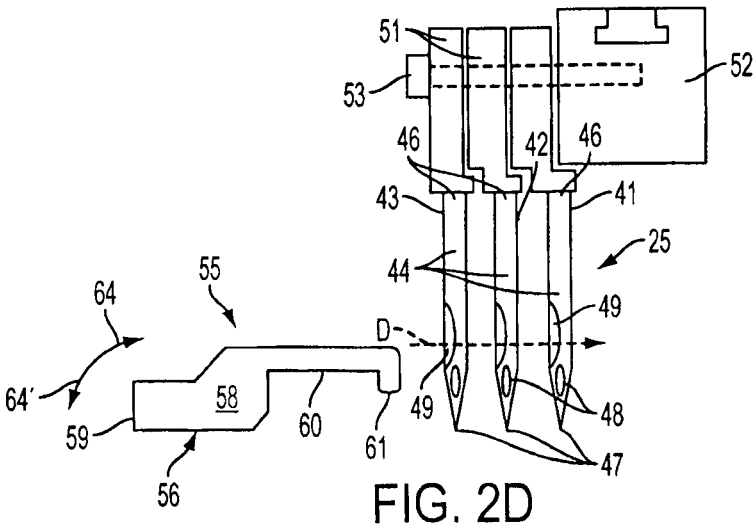
Figure 3A:
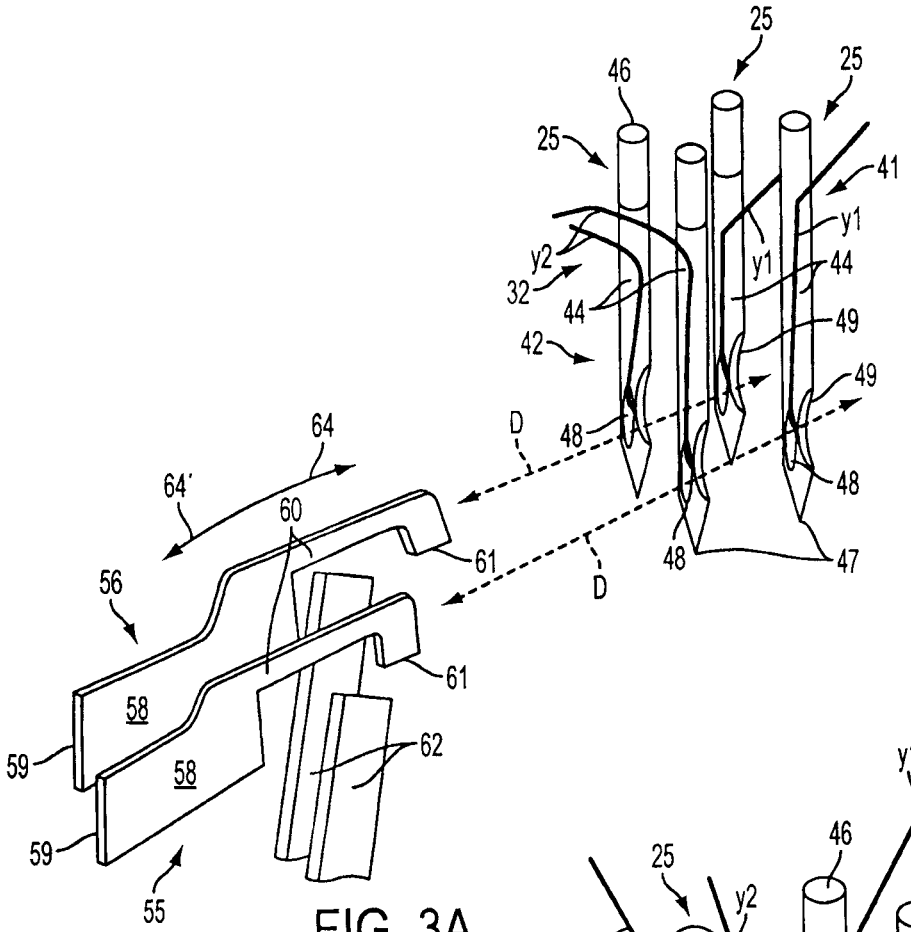
FIGS. 3A and 3B illustrate one example of embodiment of the engagement of multiple rows of needles by cut pile hooks.
Figure 3B:
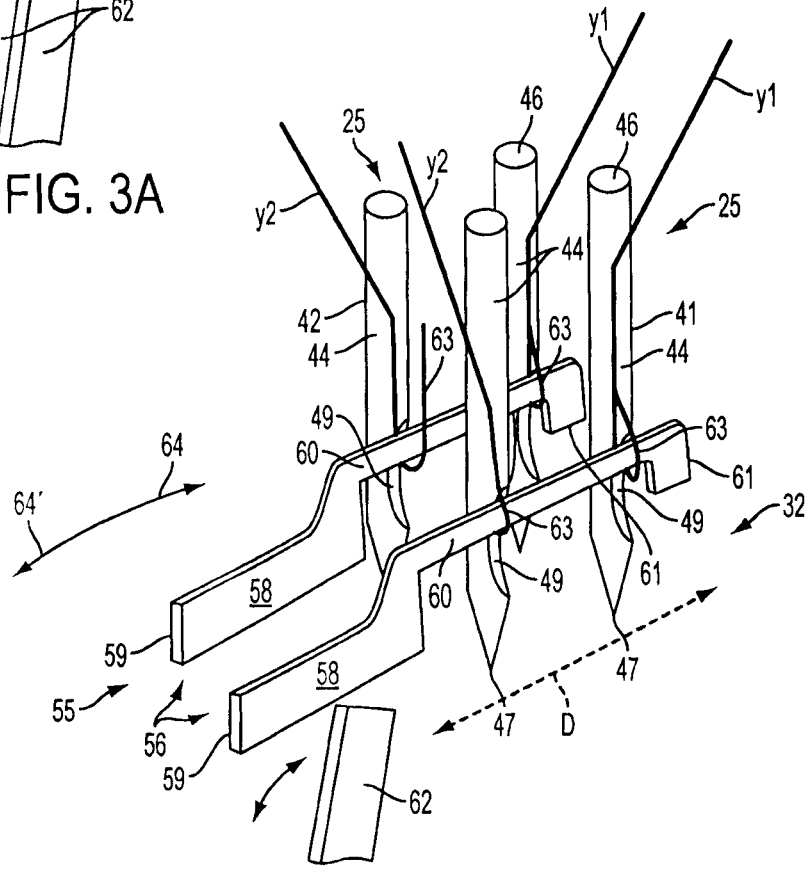

Each of the rows of needles also generally will be mounted in a substantially parallel alignment along their needle bar(s), with the rows longitudinally staggered from one another as indicated in FIGS. 1 and 3A-3B. The longitudinal spacing or stagger of the rows 41-43 (FIGS. 2A-3B) generally will be at a minimum stagger distance available in view of the geometry and/or size of the needles being used. By way of example and not limitation, if $1/10^{th}$ gauge needles are used, such as for forming a $1/10^{th}$ gauge fabric, the rows of needles can be longitudinally spaced or staggered by approximately ⅛ of an inch to about ¼ of an inch, although greater or lesser longitudinal staggers also can be used depending on the needle geometry and/or size. The needles of each row of needles 41-43 further generally will be aligned in an effectively in-line relationship or configuration whereby the needles are not required to be precisely or directly in-line, rather one or more of the rows of needles, can be moved or aligned slightly toward the pickup side of the tufting zone along which a series of gauge parts 55 will engage each of the longitudinally staggered and aligned needles of each of the rows of needles so as to form multiple tufts during a single tuft cycle or stroke of the needles.

As indicated in FIGS. 2A-3B, each of the needles 25 generally will include elongated body 44 having a shank or first end 46 received within a needle bar 18 and a second, pointed and distal end 47. Each of the needles further generally will include an eye 48 adjacent at the distal end and take-off portion or area 49 adjacent the eye opening 48. The needles each receive a yarn from the one or more yarn feed mechanisms, with the yarn feed thereto being controlled so as to be variable as needed to form desired patterns or pattern effects, such as forming high/low tufts, during shifting of the one or more needle bars, etc.

As further generally illustrated in FIGS. 2A-2D, the rows of needles can be mounted along a single needle bar 18, with the needles being arranged in 2, 3, or more rows 41-43, as illustrated in FIGS. 2A and 2B, respectively. While 2-3 rows of needles are shown in the Figures, it will be understood by those skilled in the art that still further numbers of rows, including 4 or more rows of needles mounted on one or more needle bars also can be used. Alternatively, as shown in FIG. 2C, the rows of needles 41 and 42 can be mounted on two separate, spaced needle bars 18/18', it further being understood that while only two rows of needles 41 and 42 are shown mounted along each of the needle bars 18 and 18', additional rows of needles also can be mounted along one or both of the needle bars 18 and 18'. In still a further alternative embodiment shown in FIG. 2D, the needles 25 can be mounted in modules 51, such as being cast in a series of needle modules, which can be arranged in stacked series, with the successive rows 41-43 of needles further being able to be slightly offset so as a place to arrange the rows of needles in an effectively in-line relationship. The modules will be secured to a needle bar or a support block 52 by a fastener 53.

As further indicated in FIGS. 2A-5, as the needles penetrate the backing material, carrying the yarns therewith, the rows of needles will be engaged by a series of gauge parts 55 mounted along one or both sides of the tufting zone 32 below the backing material, and generally arranged at an elevation for forming a desired pile height of tufts T of yarns Y1 and Y2 in the backing material, as indicated in FIG. 1. As further shown in FIGS. 2A-3B, each of the gauge parts 55 generally will be reciprocated by distance D that is sufficient to enable at least a portion or selected ones of the gauge parts to engage each of the longitudinally aligned needles 25 of the transverse tuft row corresponding to or associated therewith. As a result, at least a portion of the gauge parts will pick-up multiple loops of yarns 63, i.e., one yarn from each of the longitudinally aligned needles of each tuft row 41-42, during each tuft cycle or stroke of the needles, as indicated in FIGS. 3A-3B. It will be understood by those skilled in the art that the length of travel D of the gauge parts will be sufficient to engage each of the associated longitudinally aligned needles of each of the tufts of the 2, 3, 4 or more tuft rows.

In addition, the backing material further will be run at an effective or actual stitch rate that is increased over or faster than a desired fabric stitch rate or a programmed pattern stitch rate for the tufted article being produced. For example, where an approximately double density gauge spacing is used between the needles, such an effective stitch rate can be about 2 times the desired fabric stitch rate. As a result, multiple tufts T of yarns Y1/Y2 (FIG. 1) are formed in the backing material during each tuft or stitch cycle or stroke of the needles, resulting in the tufts T of the tufted fabric being formed with a desired fabric stitch rate at an increased production rate.

Figure 6:
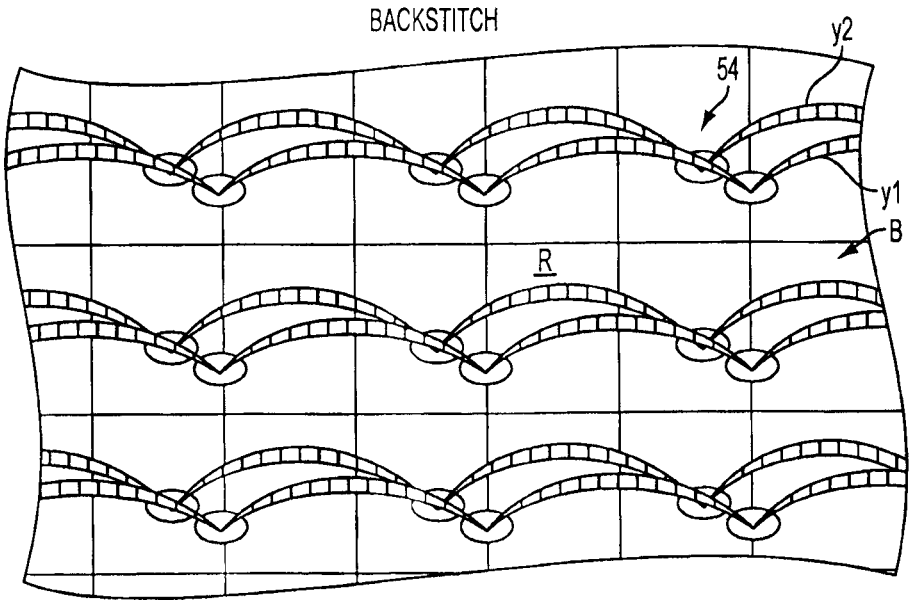
FIG. 6 illustrates an example of a back-stitch pattern of tufts formed using a system and method in accordance with the principles of the present invention.
Figure 7A:
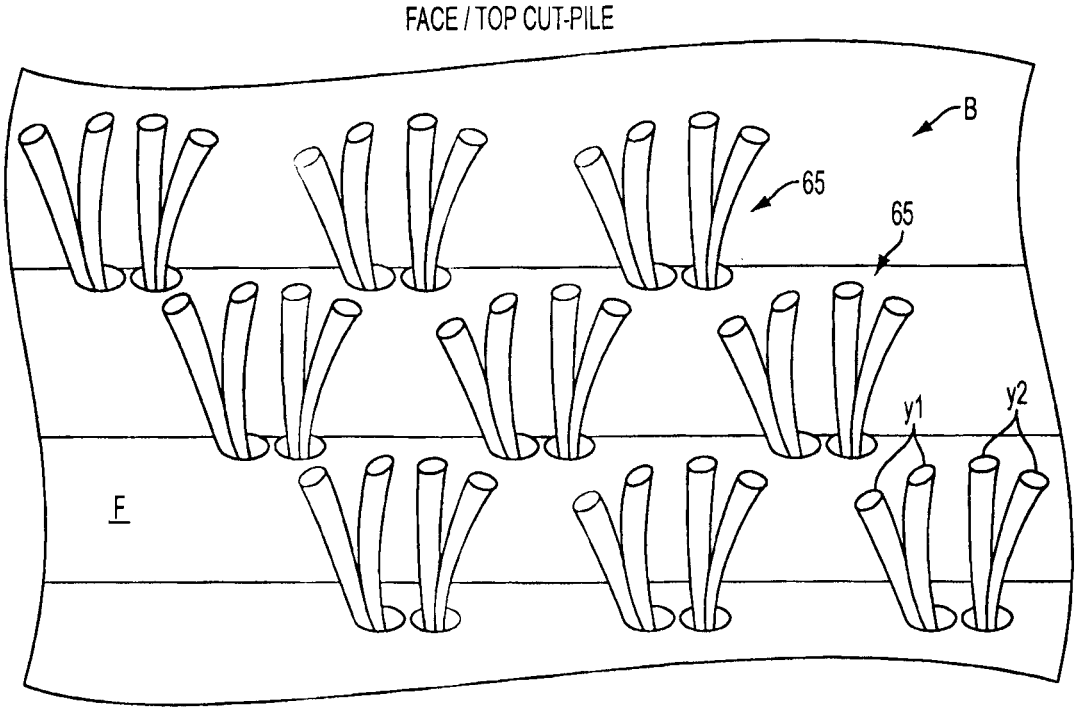
FIG. 7A illustrates the face or top of the backing material with a series of cut pile tufts formed thereon using a system and method in accordance with the principles of the present invention.
Figure 7B:
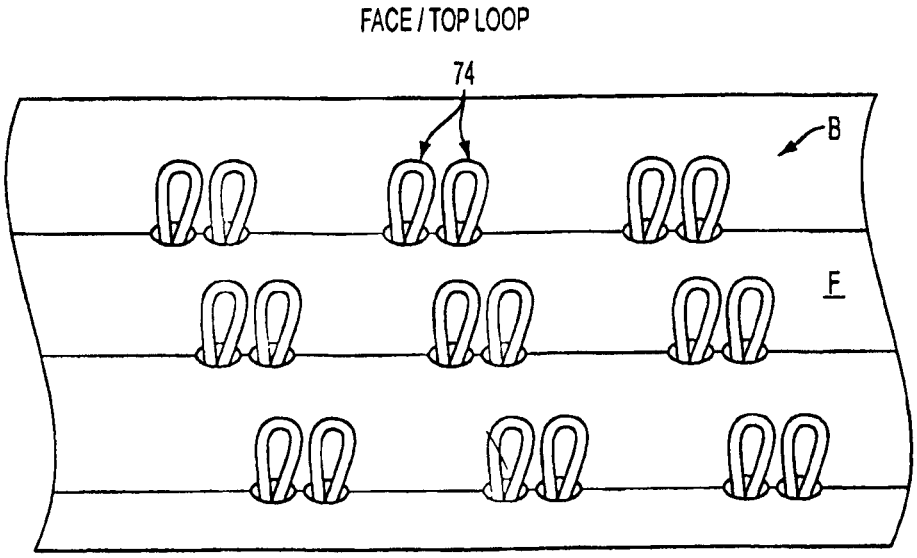
FIG. 7B illustrates the face or top surface of the backing material with a series of loop pile tufts formed therein using a system and method in accordance with the principles of the present invention.
Figure 7C:
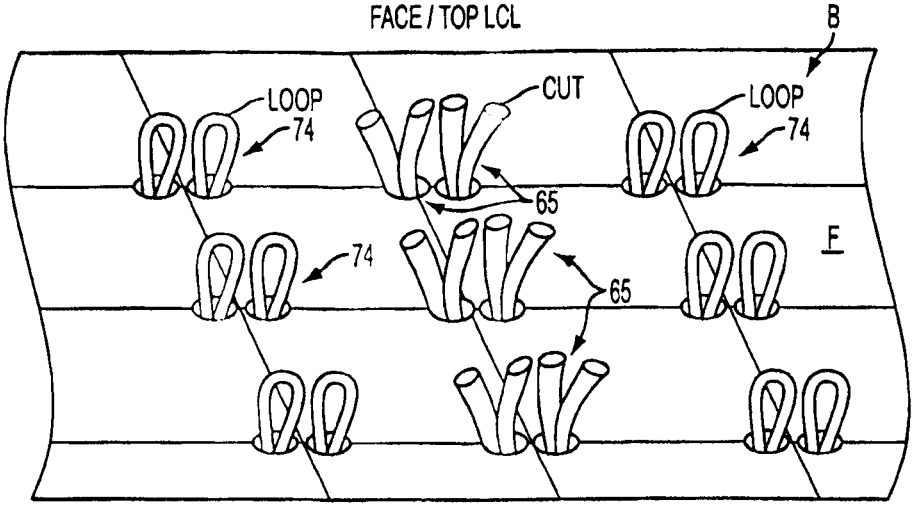
FIG. 7C illustrates the face or top surface of the backing material having a series of loop pile tufts and cut pile tufts formed therein using a system and method in accordance with the principles of the present invention.

FIG. 6 illustrates an example of the back stitches 54 formed on a rear or back side R of the backing material B. As indicated, the needles of each row (here shown with 2 rows 41/42 in one example) can penetrate the backing material at locations or positions spaced longitudinally, and generally offset or laterally spaced slightly out of alignment. The longitudinal stagger/spacing and transverse or lateral spacings of the back stitches 54 further can be varied, i.e., by being increased or decreased, as needed depending on the desired density and/or spacings of the tufts T to be shown on the face F of the backing material, such as illustrated in FIGS. 7A-7C. The resultant tufted fabric or article is thus formed with the desired number of stitches per inch for the selected fabric gauge or pattern, i.e., 10 stitches per inch for $1/10^{th}$ gauge fabric, 8 stitches per inch for a $1/8^{th}$ gauge fabric, 16 stitches per inch for a $1/16^{th}$ gauge fabric, etc., but can be formed at an increased production rate.

In one example embodiment, the gauge parts 55 generally will include a series of cut pile hooks 56, typically mounted along a hook bar 57 or module located along a downstream side of the tufting zone, as indicated in FIG. 1. As illustrated in FIGS. 2A-3B, each of the cut pile hooks will include an elongated body 58 having a shank or rear portion 59, an elongate throat 60 and a hooked bill or forward end 61. A series of knives or cutting blades 62 further generally will be associated with each of the cut pile hooks 56, with the knives generally being reciprocated into engagement with and/or along the throat portions of the cut pile hooks so as to cut or sever any loops of yarns L (FIG. 3B) captured therealong.

As also indicated in FIGS. 3A and 3B, each of the cut pile hooks will be reciprocated in the direction of arrows 64 and 64' toward and away from the needles 25 as the needles penetrate the backing material. Each of the cut pile hooks can move along a distance or path of travel D sufficient to pass by and engage corresponding or associated ones of the longitudinally aligned needles of each of the transverse tuft rows of needles along the take-off portions 49 thereof, to enable the picking up and capture of multiple loops of yarns 63, during a single tuft cycle or needle stroke. As the cut pile hooks are retracted in the direction of arrows 64', the loops of yarns are captured and retained along the throat portions of each of the cut pile hooks by the hooked bills 61 thereof. As a result, at least a portion of the cut pile hooks will pick multiple yarns from the needles, typically one yarn from a needle of each row of needles aligned or associated with such cut pile hook. Thereafter, the knives 62 can be reciprocated into engagement with the cut pile hooks and will sever or cut the captured loops of yarns to thus form multiple cut pile tufts 65 during each tuft cycle or needle stroke as shown in FIG. 7A. It will be understood by those skilled in the art that the length of travel D of the cut pile hooks will be sufficient to engage each of the associated longitudinally aligned needles of each of the tuft of the 2, 3, or more tuft rows.

Figure 4:
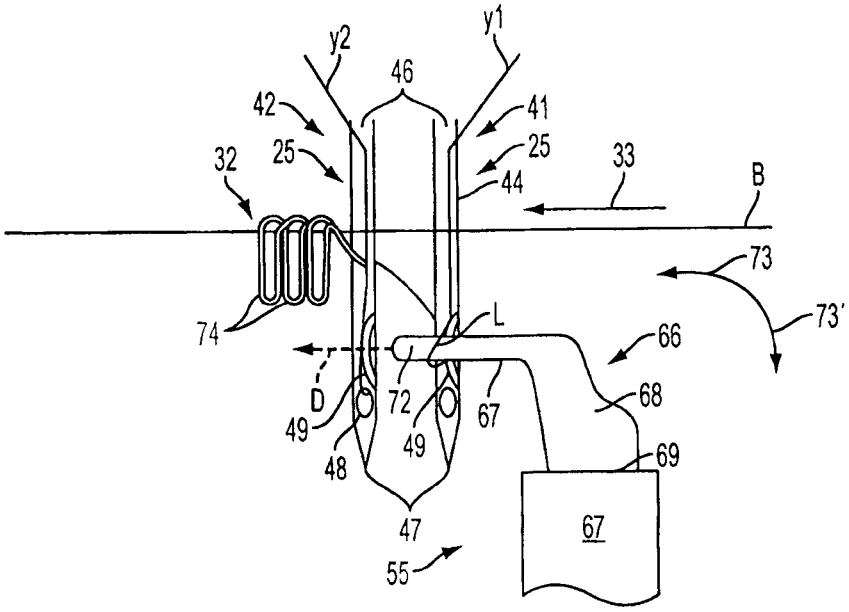
FIG. 4 is a side elevational view schematically illustrating the engagement of the multiple rows of needles by a loop pile looper.

FIG. 4 illustrates an alternative embodiment in which the gauge parts 55 include loop pile loopers 66. In this embodiment, the loop pile loopers 66 generally can be mounted along a support or looper bar 67 and can be located along an upstream side of the tufting zone. Each of the loop pile loopers generally will include a body 68 having a shank or first-end 69 received within the looper bar 67, and a throat portion 71 terminating in a second, distal or pointed end 72. As indicated in FIG. 4, the loop pile loopers will be reciprocated across the tufting zone along a path of travel in the direction of arrows 73/73' by distance D so as to engage their associated or corresponding ones of the longitudinally aligned needles of each of the multiple transverse rows of needles with at least a portion of the loopers picking multiple loops L of yarn Y1/Y2 therefrom (i.e., typically picking a loop of yarn from each needle engaged thereby). As the loopers are reciprocated in the direction of arrow 73' away from their engagement with the needles, the loops of yarns will be released from the throats of the loopers so as to form multiple loop pile tufts 74 in the backing material during each needle stroke or tuft cycle, as indicated in FIGS. 4 and 7B.

Figure 5:
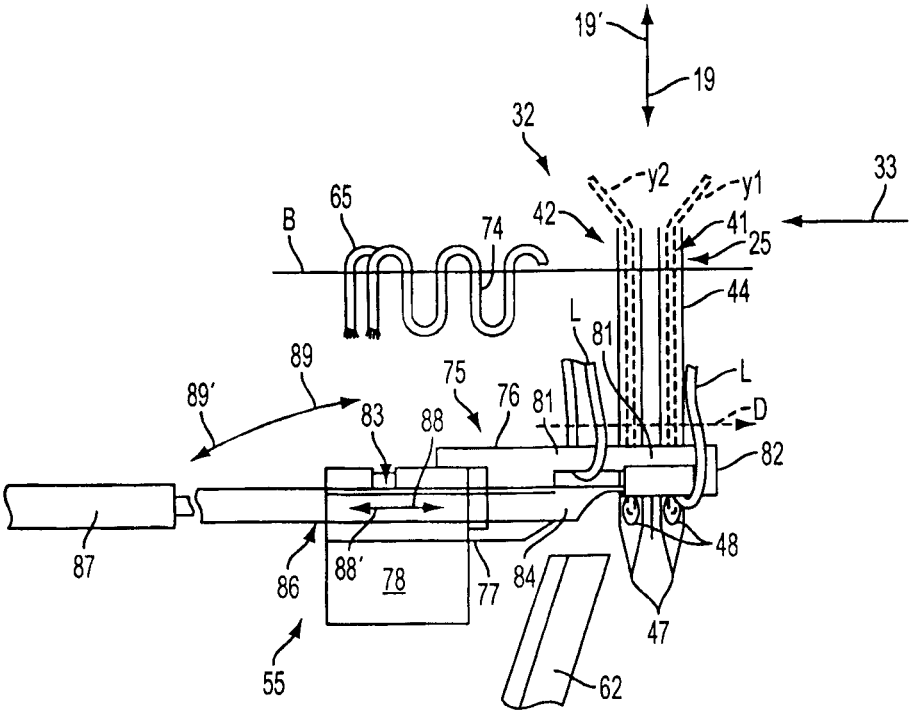
FIG. 5 is a side elevational view schematically illustrating the engagement of multiple rows of needles by a level cut loop looper assembly.

A still further alternative embodiment is generally illustrated in FIG. 5, wherein the gauge parts 55 can include level cut loop loopers 75 that can selectively operable to form a series of cut pile tufts 65 or a series of loop pile tufts 74, such as shown in FIGS. 5 and 7C. Each of the level cut loop loopers generally will include a body 76 having a first end or shank 77 mounted within a hook bar 78, a throat portion 81 that extends forwardly from the shank and terminates in a hooked or curved bill or front second/end portion 82. In addition, a gate 83 can be mounted along or adjacent the body of each level cut loop looper, with each gate generally including a first or forward end 84 adapted to engage the hooked bill or front-end 82 of its associated level cut loop looper, and second or distal end 86 that extends through the hook bar 78 and can be connected to an actuator 87 for controlling a sliding movement of the gates in the direction of arrows 88 and 88' as indicated in FIG. 5. An example of level cut loop looper assembly is shown in U.S. Pat. No. 7,739,970, the disclosure of which is incorporated by reference as if set forth fully herein.

The level cut loop loopers 75 will be reciprocated in the direction of arrows 89 and 89', toward and away from the tufting zone and the needles, by a distance D sufficient to pick and/or capture loops of yarns L from the needles of each longitudinally aligned row of needles associated therewith so as to thus form multiple tufts T during each tuft cycle or needle stroke. If the gates 83 are in an extended, engaging position, the loops of yarns will be released as the level cut loop loopers are retracted in the direction of arrow 89', to thus form loop pile tufts 74 as shown in FIGS. 5 and 7C. If the gates 83 (FIG. 5) are in a retracted, non-engaging position, the loops of yarns will be captured on the throats thereof, after which knives 91 can be reciprocated into engagement with the level cut loop loopers to form cut pile tufts 65 as shown in FIGS. 5 and 7C.

It will be understood by those skilled in the art that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural references unless the context clearly dictates otherwise.

Unless defined otherwise, all technical and scientific terms used herein have the same meanings as commonly understood by one of ordinary skill in the art in the field to which this invention is directed, and it will be understood that any methods and materials similar or equivalent to those described herein can be used in the practice or construction of the invention.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

The invention claimed is:

1. A method of forming tufted articles comprising:

moving a backing through a tufting zone;

feeding a series of yarns to a series of needles, wherein the needles are arranged in at least two rows along one or more needle bars, and wherein the needles of each row of needles are transversely spaced apart by a distance that is less than a prescribed gauge spacing for the tufts of the tufted article;

reciprocating the needles into and out of the backing;

engaging the needles of each row of needles with a series of gauge parts, at least a portion of the gauge parts engaging at least one needle of each of the rows of needles so as to pick at least one yarn from the at least one needle of each row of needles engaged thereby; and forming a series of tufts of yarns in the backing;

wherein the tufted article is formed with a desired stitch density at an increased production rate.

2. The method of claim 1, wherein moving the backing through the tufting zone comprises feeding the backing at an increased effective stitch rate that is greater than a desired fabric stitch rate for the tufted article.

3. The method of claim 2, wherein the effective stitch rate at which the backing is fed through the tufting zone is at least approximately double the desired fabric stitch rate.

4. The method of claim 1, wherein the at least two rows of needles are mounted in a substantially parallel arrangement along a single needle bar, with the needles of each row longitudinally staggered by a minimum stagger distance sufficient to enable movement of each row of needles into the backing and engagement of the needles of each row by the gauge parts to form the tufts of yarn.

5. The method of claim 1, wherein the needles of the rows of needles are arranged in an effectively in-line alignment, longitudinally staggered from each other.

6. The method of claim 1, wherein forming a series of tufts comprises forming a series of cut pile tufts in the backing.

7. The method of claim 1, wherein forming a series of tufts comprises forming a series of loop pile tufts in the backing.

8. The method of claim 1, wherein forming a series of tufts comprises selectively forming a series of cut pile and/or loop pile tufts in the backing.

9. The method of claim 1, wherein feeding a series of yarns to the needles comprises selectively controlling the yarns fed to the needles of each row of needles according to pattern instructions.

10. A system for forming tufted articles, comprising:

a frame defining a tufting zone;

backing feed rolls feeding a backing material through the tufting zone;

at least two rows of needles mounted in transversely spaced series along at least one needle bar, the at least one needle bar being reciprocally movable toward and away from the backing material;

wherein the needles of the at least two rows of needles are arranged at a transverse spacing that is substantially less than a desired fabric gauge spacing for the tufts of the tufted article, the rows of needles being mounted effectively in-line, longitudinally staggered across the tufting zone;

a yarn feed mechanism for feeding yarns to the needles; and a series of gauge parts mounted below the backing material and adapted to move along a reciprocating path of travel a distance sufficient to enable at least a portion of the gauge parts to engage corresponding needles of each of the rows of needles;

wherein as the needles are reciprocated into and out of the backing during each tufting cycle, multiple tufts of yarns are formed in the backing material to form the tufted articles having a desired number of stitches per inch at an increased production rate.

11. The system of claim 10, wherein the gauge parts comprise cut pile hooks.

12. The system of claim 10, wherein the gauge parts comprise loop pile loopers.

13. The system of claim 10, wherein the gauge parts comprise level cut loop loopers.

14. The system of claim 10, wherein the yarn feed mechanism comprises front and rear yarn feed devices mounted on opposite sides of the tufting zone for feeding yarns to each of the needles of the at least two rows of needles.

15. The system of claim 10, wherein the yarn feed mechanism comprises at least one standard yarn feed device, single end yarn feed device, double end yarn feed device, pattern yarn feed roll or pattern yarn feed scroll.

16. The system of claim 10, wherein the at least two rows of needles comprise three or more rows of longitudinally spaced needles mounted along a single needle bar.

17. The system of claim 10, wherein the at least two rows of needles comprise three or more rows of longitudinally spaced needles mounted along at least a pair of needle bars.

18. The system of claim 10, wherein each row of needles is mounted within at least one needle module, with the needle modules of each row of needles mounted in stacked series along a support.

* * * * *